US005388492A

United States Patent [19]

Olson

[11] Patent Number: 5,388,492

[45] Date of Patent: Feb. 14, 1995

[54] "L" GUITAR SUPPORT

[76] Inventor: Joan E. Olson, 204 Diamond Dr., Walkersville, Md. 21793

[21] Appl. No.: 142,871

[22] Filed: Oct. 28, 1993

[51] Int. Cl.[6] ..... G10D 3/00

[52] U.S. Cl. ..... 84/327; 224/910

[58] Field of Search ..... 84/327, 453; 224/910

[56] References Cited

U.S. PATENT DOCUMENTS 1,261,841 4/1918 Mortensen ..... 84/327

4,966,062 10/1990 Drigger et al. ..... 84/327

*Primary Examiner*—Michael L. Gellner

*Assistant Examiner*—Cassandra C. Spyrou

[57] ABSTRACT

The "L" Guitar Support is a very effective, simple apparatus for supporting a guitar from beneath; when in use it attaches to the guitar with suction cups and rests on the guitarist's left leg. When not in use it can be flattened against the side of the guitar to a ¼" thickness which makes it more possible to be able to remain on the guitar even when the guitar is in the case. Due to its design simplicity this support is not vertically rigid and the natural movement of the body can be maintained by the musician.

1 Claim, 2 Drawing Sheets

"L" GUITAR SUPPORT

BRIEF SUMMARY OF THE INVENTION

The "L" Guitar Support is used on a classic guitar and supports the guitar from beneath; it attaches with suction cups to the guitar and rests on the guitarist's leg during use. While there has been a support apparatus provided for use while the guitarist is in the sitting position (patent to Drigger et al U.S. Pat. No. 4,966,062), it will be shown that while the new "L" Guitar Support achieves the same objective of supporting the guitar while it is used in the sitting position, it does so by using a much different structured apparatus than that utilized by Driggers.

DETAILED DESCRIPTION

Figure 1:
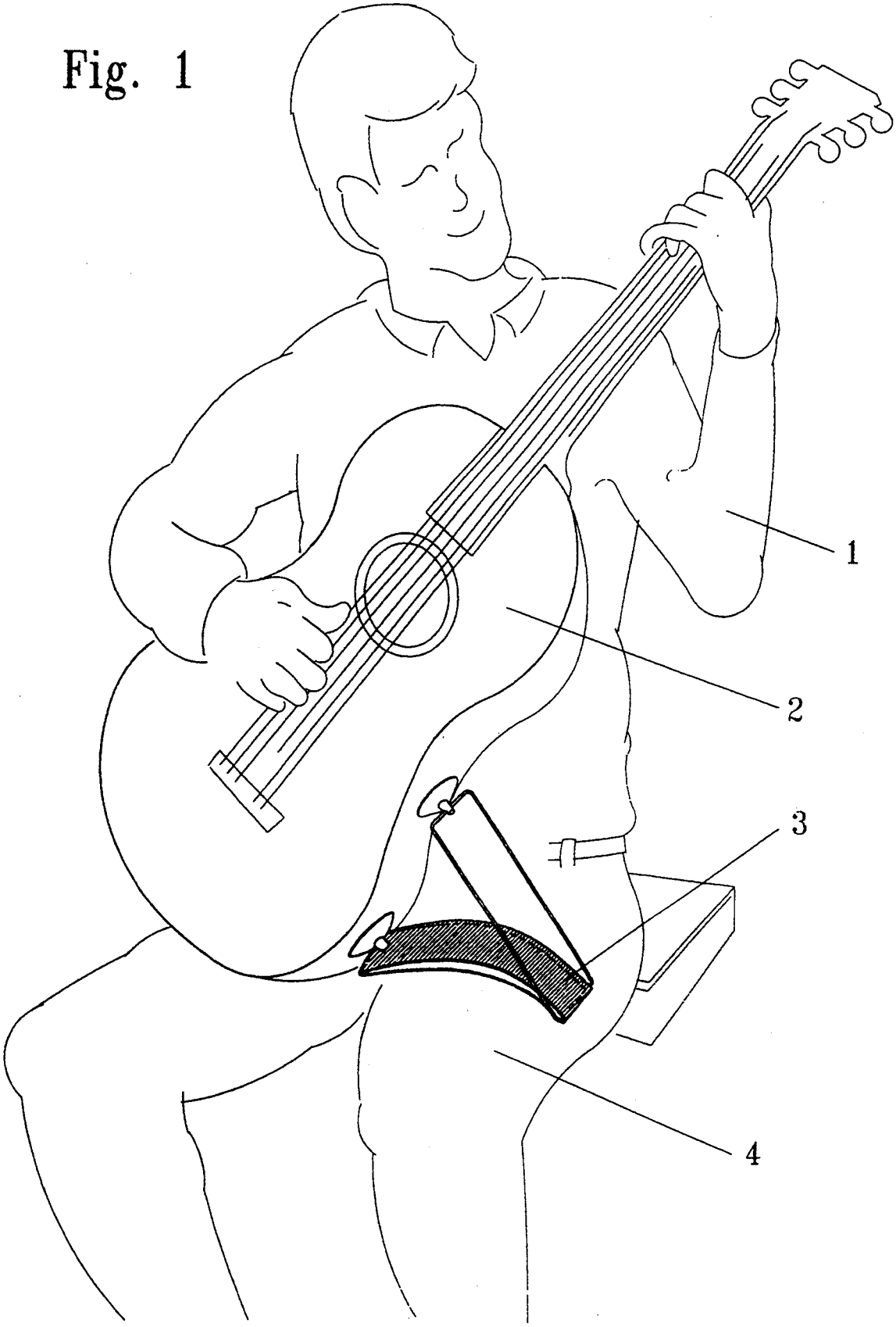
FIG. 1 of the drawings is a view of a guitarist using the "L" guitar support.
Figure 2:
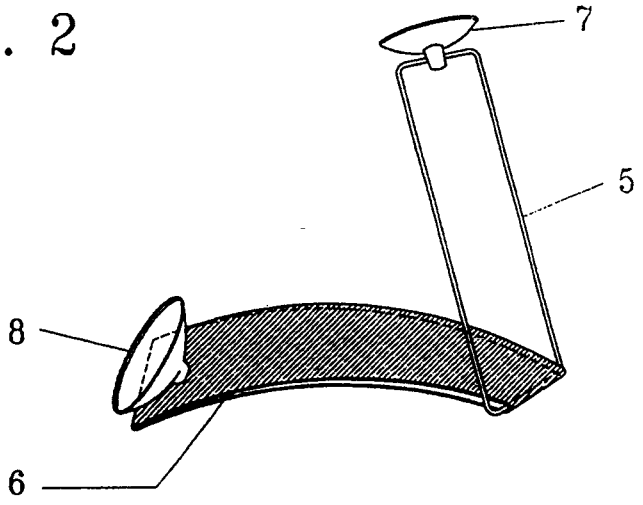
FIG. 2 of the drawings is a prespective view of the guitar support using velcro as the flexible and adjustable element.

FIG. 1 illustrates a guitar (2) played by a guitarist (1) using the "L" guitar support (3). The apparatus (3) will be further described with reference to FIG. 2 of the drawings. The "L" guitar support is positioned over the guitarist's leg (4). It is seen in FIG. 2 of the drawings that the apparatus is formed by one rigid support (5) which is attached to one flexible support (6); these two supports having a suction cup each at their far ends (7) (8).

These two elements-one rigid support (5) and one flexible support (6) having each a suction cup at their far ends (7) (8) make the total workable apparatus.

Figure 3:
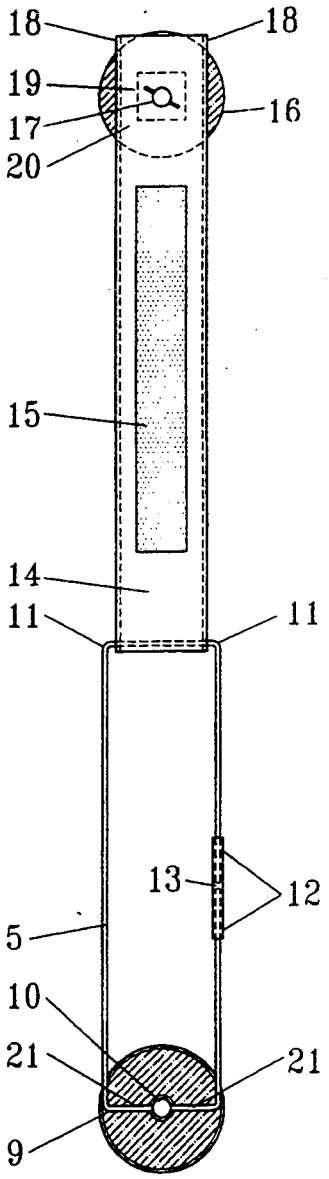
FIG. 3 of the drawings is a view of the guitar support of FIG. 2 in a totally flat position.

FIG. 3 of the drawings is a view of the apparatus, FIG. 1 (3), in a totally flat position detailing its construction and the use of velcro for the flexible and adjustable element. It is seen that the apparatus is formed of a rigid support (5), a ⅛" diameter brass rod, which is bent at 90 degree angles at the four corners and which passes through a suction cup (9); the rigid element (5) passes through a flexible element (14), in this case a double layered velcro (14), along line 11—11. The two cut ends of the brass rod (12) are joined by a brass sleeve (13), a 5/32" diameter length of brass tubing which has a crimp in the center to prevent slippage.

The flexible element (14) of the apparatus is shown in FIG. 3 as a double layered velcro which has been seamed together at line 11—11 and wrapped around the brass rod. A piece of rubber backed fabric (15) is sewn through one layer of the velcro so that the double layered velcro can be separated to allow for any change of placement of the brass rod which passes between the layers; this is shown at line 11—11. The apparatus has a suction cup attached by means of a ¼" diameter hole (17) in the under-layer of velcro through which the hub of the suction cup is inserted and a ⅛" brass rod (19) approximately 1" in length, is inserted through the hub of the suction cup to keep it in place. A square line of stitching (20) through both layers of velcro keeps the brass rod (19) in place. Two layers of velcro are stitched together along line 18—18.

Figure 4:
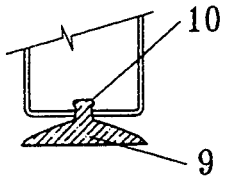
FIG. 4 of the drawings is a cross-sectional view along line 21—21 of FIG. 3.

FIG. 4 of the drawings is a cross-sectional view along line 21—21 of FIG. 3 showing the brass rod passing through the hub (10) of the suction cup (9).

I claim:

1. A guitar support comprising:

a rod having a first and second end; said rod having a generally rectangular configuration including a first edge and a second edge opposite to said first edge;

Means for fastening said first end to said second end of said rod;

A first suction cup for securement to said guitar having a hub; said first edge of said rod passing through said hub;

A flexible element having a first side and a second side; said second edge of said rod fastened to said first side flexible element;

A second suction cup for securement to said guitar attached to said second side of said flexible element.

* * * * *